United States Patent [19]

Moyle

[11] 4,248,361

[45] Feb. 3, 1981

[54] TOOTHPASTE TUBE HOLDING AND CLOSING DEVICE

[76] Inventor: Austin Moyle, 2700 N. Meridian Rd., Meridian, Id. 83642

[21] Appl. No.: 77,674

[22] Filed: Sep. 21, 1979

Related U.S. Application Data

[63] Continuation-in-part of Ser. No. 859,261, Dec. 12, 1977, abandoned.

[51] Int. Cl.[3] ..... B65D 35/56

[52] U.S. Cl. ..... 222/179.5

[58] Field of Search ..... 222/179.5, 180, 105, 222/80; 248/108, 109

[56] References Cited

U.S. PATENT DOCUMENTS

| | | | |
|---|---|---|---|
| 382,218 | 5/1888 | Dehnert | 222/179.5 |
| 1,349,842 | 8/1920 | McKinley | 222/180 X |
| 1,467,082 | 9/1923 | Baldwin | 248/109 X |
| 2,259,992 | 10/1941 | Binon | 222/179.5 |
| 2,324,575 | 7/1943 | Groedel | 248/108 |
| 2,393,103 | 1/1946 | Groedel | 222/80 UX |
| 3,817,426 | 6/1974 | Fooks | 222/105 |

FOREIGN PATENT DOCUMENTS

| | | | |
|---|---|---|---|
| 980094 | 5/1951 | France | 222/105 |

*Primary Examiner*—David A. Scherbel
*Attorney, Agent, or Firm*—Paul F. Horton

[57] ABSTRACT

Apparatus for holding and closing tubes of the type used for toothpaste and toiletries in general is disclosed. The apparatus includes a primary tube guide and a secondary guide, a tapered plug axially centered with the guide and a support for holding the guide in a fixed spaced relationship to the plug. The guide and the plug may be attached in vertical spaced relationship to a wall. In operation, a tube of toothpaste, with cap removed, is dropped into the primary guide in an inverted position. The secondary guide directs the opening of the tube onto the plug independently of size of tube, thereby sealing the contents of the tube.

5 Claims, 5 Drawing Figures

TOOTHPASTE TUBE HOLDING AND CLOSING DEVICE

BACKGROUND OF THE INVENTION

This application is a continuation-in-part of my application U.S. Ser. No. 859,261 filed on Dec. 12, 1977, and now abandoned.

FIELD OF THE INVENTION

This invention relates, in general, to tube holding and closing devices, and in particular, the tube closing devices which are closed by means of their own weight.

DESCRIPTION OF THE PRIOR ART

The inconvenience associated with tubes of toothpaste and tubes of toiletries, in general, which have been left open are well-known. The contents of such tubes often become hard and therefore not suitable for use. The contents may also become contaminated with impurities and therefore become unuseable. In addition, the caps for such tubes are often lost or mislaid, and the contents, with the tube laying flat, spill out resulting in waste and untidiness.

Tube holding and closing devices in the prior art are largely limited to devices for dispensing the contents of such tubes. Such devices do not permit convenient interchangeability of tubes; generally do not effect a tight seal over the tube opening; and often do not allow hand dispensing, often desired by the operator. It has been found that toothpaste holders lacking a secondary tube guide are unsuitable for tubes varying in size.

SUMMARY OF THE INVENTION

The present invention comprises apparatus for holding and closing tubes of the types used for toothpaste and toiletries, including a tapered plug for sealing the tube opening, a primary tube guide for holding the tube, a secondary tube guide for centering the tube on the plug, and a support for holding the guide in fixed relationship to the plug.

It is therefore a general object of the invention to provide tube holding and closing apparatus which is relatively inexpensive, efficient, convenient to operate, and simple in construction.

It is also an object of the present invention to provide tube holding and closing apparatus which utilizes the weight of the tube and its contents to effect a closing seal.

It is a further object of the present invention to provide tube holding and closing apparatus in which the tube opening is automatically centered on a tapered plug by means of a primary guide chute and a secondary guide chute.

A still further object of the present invention is to provide tube holding and closing apparatus having interchangeable tapered plugs.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
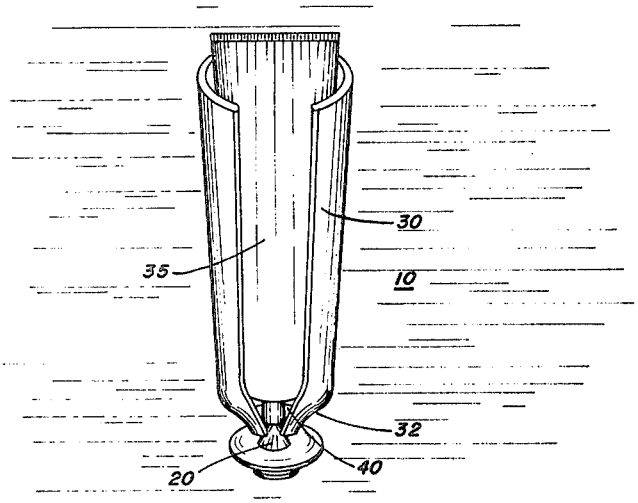
FIG. 1 is a perspective view of a preferred embodiment of the tube holding and closing apparatus of the present invention shown mounted to a wall.

Referring now to the drawings, and, more particularly, to FIG. 1, an embodiment to be preferred of a toothpaste tube holding and closing device 10, made according to the present invention, is disclosed. Apparatus 10 includes a tapered plug 20, a primary tube guide 30, a secondary guide 32, and support 40 for holding guides 30 and 32 in a fixed spaced relationship with plug 20.

Figure 2:
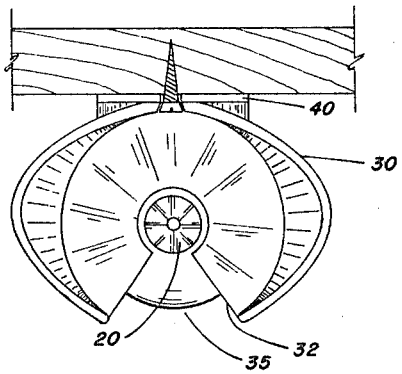
FIG. 2 is a plan view of the device of FIG. 1.

Guide 30 is essentially a tapered cylinder, elliptical in cross section. The guide may or may not have a frontal void 35, as shown in FIGS. 1 and 2, the void permitting less costly construction and also permitting a view of the tube held. The tube guide may be constructed of any suitable material, polyethylene or polyvinyl being preferred. Purpose of guide tube 30 is to hold a tube of, for example, toothpaste in an inverted manner, as shown in FIG. 1, and to guide the tube into approximate axial alignment with plug 20, as will hereinafter be explained.

Secondary guide 32 is securely attached to the lowermost terminal end of primary guide 30 and is preferably integral therewith. Secondary guide 32 is substantially bell-shaped in configuration having the wider flared portion connected to the base of guide 30 and the narrow open neck portion centered over plug 20. Guide 32 may either have a front opening continuous with frontal void 35 of guide 30 or may be closed. The bell-shape of secondary guide 32 is deemed critical in that a simple funnel shape will not accomplish the desired effect. It is essential that the angle of the guide adjacent plug 20 be very acute so that the tube may drop onto the plug with some impetus.

The tube guides are held in axial alignment with plug 20 by means of support 40. Support 40, in the preferred embodiment, is an L-shaped member having a vertically extending leg **40*a* and a shorter, transversely joined, horizontally extending leg 40*b*, as may be seen in FIG. 4. Leg 40*a* may contain apertures 47 for wall mounting by means of screws 46; may contain an adhesive strip, conventional in the art, on its back side; or may be attached to the wall in other conventional manner. Additionally, support 40 may be attached to a base housing, not shown, for placement on a countertop, thus making the wall attachment unnecessary. Support 40 is preferably made of the same material as tube guides 30 and 32 and may be integral therewith. It is also within the contemplation of this invention that the tube guides 30 and 32 and tapered plug 20 may be mounted upon a wall separately and without a common support, it only being essential that the tube guides be mounted in axial alignment with plug 20**.

Figure 3:
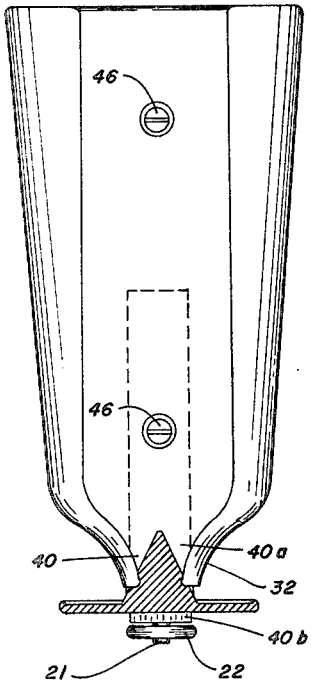
FIG. 3 is a front view of the device of FIG. 1.
Figure 4:
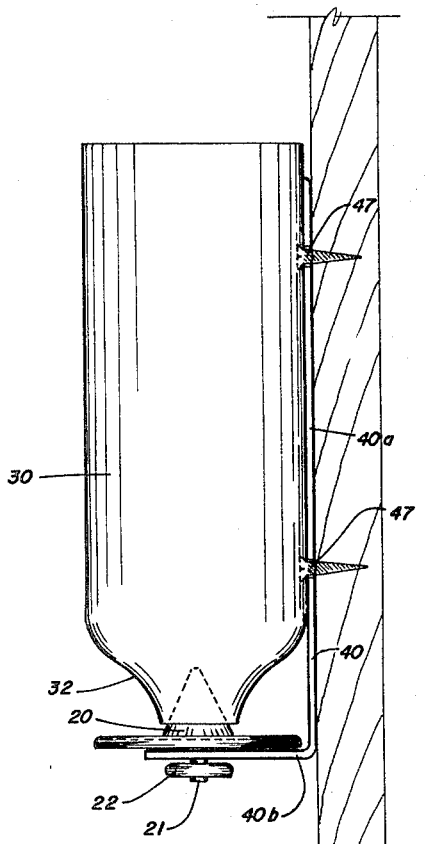
FIG. 4 is a side elevation of the device of FIG. 1.
Figure 5:
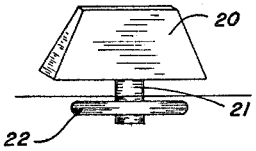
FIG. 5 is a perspective view of one of the tapered plugs of the present invention.

Tapered plug 20, is preferably conical in shape, as shown in FIGS. 3 and 4, and therefore capable of sealing round tube openings of varying diameters. The tapered plug may be attached directly to leg **40*b* by welding, adhesive, or the like, and may be integral therewith. In the preferred embodiment, plug 20 is attached to leg 40*b* by means of screw 21 and nut 22. It is to be understood that other conventional means may be used for attaching the plug to the leg, as by means of snaps or pins. While a conical shaped plug is preferred, in that the majority of tubes have a round opening, other tubes having a rectangular opening are currently in vogue thereby requiring a tapered rectangular plug, as shown in FIG. 5. Detachable mounting means permit quick and convenient replacement of plug 20** to conform to the tube opening.

In use, a tube of any conventional size containing, for example, toothpaste, with cap removed, is placed in an inverted position into guide 30, as may be seen in FIG. 1. The tube guide, being tapered downwardly, directs the tube opening downwardly toward tapered plug 20. Where larger tubes are used, tapered guide 30 is sufficient to align the tube opening with the plug. In the event smaller tubes are used, the primary guide 30 will guide the open end of the tube in the general direction of the plug. Once the tip of the tube nozzle or the shoulder of the tube makes contact with the flared opening of secondary guide 32, the tube opening is further guided to center itself on plug 30. It is therefore apparent that tubes of varying sizes may be used with the apparatus obviating need for separate holders. The weight of the tube together with its contents holds the tube opening in sealed engagement with tapered plug 20, thereby preventing appreciable loss of the contents. When toothpaste is again desired, the operator simply lifts the tube vertically from guide 30 and squeezes the tube to discharge the contents. Need for the cap is thereby eliminated. In this manner, tube contents are kept fresh, uncontaiminated, and spilling of the contents is minimized.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. Apparatus for holding and closing tubes of the type used for toothpaste and toiletries comprising:

a tapered plug partially insertable into the tube opening and adapted to sealingly engage the tube opening;

a primary tube guide having a frontal void and axially aligned with said plug and including a jacket, longitudinally tapered from top to bottom, substantially elliptical in cross section and operable to direct the tube opening toward said plug;

a secondary, inverted bell shaped, tube guide depending downwardly from said primary guide and operable to center the tube opening on said plug and retain the tube in an inverted vertical position; and support means for holding said guide means in a fixed relationship to said plug.

2. Apparatus as described in claim 1 further comprising wall attachment means operable to hold said guide means in a vertical spaced relationship to said tapered plug.

3. Apparatus as described in claim 1 wherein said support means comprises an L-shaped member having two transversely joined legs, one of the legs supporting said tapered plug and the other leg supporting said guide means.

4. Apparatus as described in claim 3 further comprising means for detachably mounting said plug to the leg of said L-shaped member.

5. Apparatus as described in claim 1 wherein said tapered plug is a cone having its apex outwardly extending in axial alignment with said guide means.

* * * * *